US007935030B1

(12) United States Patent
Nesbitt

(10) Patent No.: US 7,935,030 B1
(45) Date of Patent: May 3, 2011

(54) WALKER APPARATUS

(76) Inventor: Jonathan C. Nesbitt, Nashville, TN (US)

( * ) Notice: Subject to any disclaimer, the term of this patent is extended or adjusted under 35 U.S.C. 154(b) by 0 days.

(21) Appl. No.: 11/827,263

(22) Filed: Jul. 11, 2007

(51) Int. Cl.
*A47D 13/04* (2006.01)
*A63B 26/00* (2006.01)

(52) U.S. Cl. ..... 482/68; 482/142

(58) Field of Classification Search ..... 482/68, 482/142
See application file for complete search history.

(56) References Cited

U.S. PATENT DOCUMENTS 2,871,915 A * 2/1959 Hogan ..... 482/69
3,204,954 A * 9/1965 Scannell ..... 482/69
3,298,367 A * 1/1967 Bergman ..... 604/246
3,758,110 A * 9/1973 Fenner et al. ..... 482/25
3,807,574 A * 4/1974 Lanza ..... 211/207
3,824,994 A * 7/1974 Soderberg, Sr. ..... 601/29
3,985,082 A * 10/1976 Barac ..... 104/89
4,086,932 A * 5/1978 Richardson ..... 135/67
4,226,413 A * 10/1980 Daugherty ..... 482/67
4,251,044 A 2/1981 Olson ..... 248/166
4,266,765 A * 5/1981 Sandoval et al. ..... 482/68
4,332,378 A * 6/1982 Pryor ..... 482/68
4,384,713 A * 5/1983 Deutsch et al. ..... 482/68
4,744,536 A * 5/1988 Bancalari ..... 248/125.8
4,802,856 A * 2/1989 Olson ..... 434/253
4,807,837 A * 2/1989 Gawlik et al. ..... 248/125.8
4,832,294 A * 5/1989 Eidem ..... 248/125.8
4,865,283 A * 9/1989 Parker ..... 248/159
4,892,279 A * 1/1990 Lafferty et al. ..... 248/125.8
4,905,944 A * 3/1990 Jost et al. ..... 248/125.8
5,031,605 A * 7/1991 Mills ..... 602/36
5,038,819 A * 8/1991 Sutphen ..... 137/343
5,110,076 A * 5/1992 Snyder et al. ..... 248/125.3
5,114,023 A * 5/1992 Lavin ..... 211/107
5,172,715 A * 12/1992 Webb ..... 135/67
5,188,323 A * 2/1993 David ..... 248/158
5,190,507 A * 3/1993 Iijima ..... 482/69
5,221,241 A * 6/1993 Bare, II ..... 482/43
5,224,717 A * 7/1993 Lowen ..... 280/1.5
5,255,697 A * 10/1993 Grauer ..... 135/67
D345,017 S * 3/1994 Fischer et al. ..... D24/130
5,402,587 A * 4/1995 Buschbacher ..... 135/67
5,403,253 A * 4/1995 Gaylord ..... 482/43
5,403,270 A * 4/1995 Schipper ..... 602/36
5,411,044 A * 5/1995 Andolfi ..... 135/66
5,419,749 A * 5/1995 Morgenstein ..... 482/99
5,476,432 A 12/1995 Dickens ..... 482/67
5,479,953 A * 1/1996 Pasulka ..... 135/66
5,502,851 A * 4/1996 Costello ..... 5/86.1
D370,195 S * 5/1996 Santos et al. ..... D12/130
5,538,268 A * 7/1996 Miller ..... 280/87.05
5,562,572 A * 10/1996 Carmein ..... 482/4
5,569,129 A * 10/1996 Seif-Naraghi et al. ..... 482/69
5,577,984 A * 11/1996 Bare, II ..... 482/43
5,603,677 A * 2/1997 Sollo ..... 482/69
5,626,540 A * 5/1997 Hall ..... 482/69
5,649,558 A * 7/1997 Richard ..... 135/67
5,662,560 A * 9/1997 Svendsen et al. ..... 482/69
5,667,461 A * 9/1997 Hall ..... 482/69
5,676,388 A * 10/1997 Bertani ..... 280/87.041
5,695,432 A * 12/1997 Soderlund ..... 482/69

(Continued)

*Primary Examiner* — Rinaldi I Rada
*Assistant Examiner* — Robert F Long
(74) *Attorney, Agent, or Firm* — Waddey & Patterson, P.C.; Ryan D. Levy

(57) ABSTRACT

An improved walker apparatus for a user with a pedestal having a plurality of attachment holes for attaching a variety of devices.

13 Claims, 3 Drawing Sheets

U.S. PATENT DOCUMENTS 5,702,326 A * 12/1997 Renteria ..... 482/68
5,704,577 A 1/1998 Gordon ..... 248/229.2
5,704,881 A * 1/1998 Dudley ..... 482/69
5,720,697 A * 2/1998 Winkel ..... 482/41
5,740,825 A * 4/1998 Brunengo ..... 135/67
5,839,740 A * 11/1998 Seeger ..... 280/87.021
5,853,015 A * 12/1998 Evans ..... 135/67
5,885,190 A * 3/1999 Reiter ..... 482/69
5,890,687 A * 4/1999 Pryor et al. ..... 248/158
6,056,673 A * 5/2000 Arrecis ..... 482/66
6,082,757 A * 7/2000 Lin ..... 280/654
6,113,129 A * 9/2000 Marques et al. ..... 280/654
6,135,929 A * 10/2000 Warner ..... 482/69
6,146,315 A * 11/2000 Schonenberger ..... 482/69
6,148,580 A * 11/2000 Weir ..... 52/651.1
6,168,548 B1 * 1/2001 Fleming ..... 482/23
6,273,844 B1 * 8/2001 Kelsey et al. ..... 482/54
D451,053 S * 11/2001 Hallgrimsson ..... D12/130
6,315,138 B1 * 11/2001 Dyson ..... 212/336
6,338,355 B1 * 1/2002 Cheng ..... 135/67
6,343,802 B1 * 2/2002 Workman et al. ..... 280/87.041
6,390,311 B1 * 5/2002 Belokin ..... 211/204
6,439,250 B1 * 8/2002 Balan ..... 135/67
6,481,730 B2 * 11/2002 Sung ..... 280/87.05
6,503,176 B2 * 1/2003 Kuntz ..... 482/66
6,537,077 B1 * 3/2003 Johnson ..... 434/258
6,554,747 B1 * 4/2003 Rempe ..... 482/38
6,578,594 B1 * 6/2003 Bowen et al. ..... 135/67
6,595,530 B2 * 7/2003 Wood ..... 280/42
6,595,865 B2 * 7/2003 Stitz ..... 473/257
6,595,906 B2 * 7/2003 Smith ..... 482/148
6,607,202 B1 * 8/2003 Palmer ..... 280/87.021
6,612,845 B1 * 9/2003 Macri et al. ..... 434/247
6,651,994 B2 * 11/2003 Hallgrimsson et al. .. 280/87.041
6,669,605 B2 * 12/2003 Scates ..... 482/69
6,672,321 B2 * 1/2004 Hamilton ..... 135/67
6,679,510 B2 * 1/2004 Perena ..... 280/250.1
6,689,075 B2 * 2/2004 West ..... 601/23
6,708,991 B1 * 3/2004 Ortlieb ..... 280/47.26
6,743,156 B1 * 6/2004 Jacques et al. ..... 482/68
6,890,288 B2 * 5/2005 Bingham ..... 482/69
6,899,660 B1 * 5/2005 Chin et al. ..... 482/66
6,932,709 B1 * 8/2005 Gubitosi et al. ..... 472/118
6,935,353 B2 * 8/2005 Hawkes et al. ..... 135/67
6,969,031 B2 * 11/2005 Ugent et al. ..... 248/125.8
7,001,313 B1 * 2/2006 Crnkovich ..... 482/68
7,125,388 B1 * 10/2006 Reinkensmeyer et al. ..... 601/5
7,131,936 B2 * 11/2006 Schlosser ..... 482/69
7,229,084 B2 * 6/2007 McKellar ..... 280/79.2
7,281,691 B2 * 10/2007 Adelman ..... 248/125.8
7,287,767 B1 * 10/2007 Gomes et al. ..... 280/87.021
7,331,906 B2 * 2/2008 He et al. ..... 482/69
7,341,543 B2 * 3/2008 Dandy ..... 482/68
7,354,382 B1 * 4/2008 Warren, II ..... 482/68
7,370,660 B2 * 5/2008 Hamilton et al. ..... 135/67
7,494,139 B2 * 2/2009 Turner et al. ..... 280/87.021
7,624,953 B2 * 12/2009 Silverman et al. ..... 248/125.1
7,731,136 B1 * 6/2010 Chisolm et al. ..... 248/129
2002/0084617 A1 * 7/2002 Torsiello ..... 280/250.1
2002/0121755 A1 * 9/2002 Workman et al. ..... 280/87.021
2003/0140417 A1 * 7/2003 Huff ..... 5/120
2004/0002407 A1 * 1/2004 Hawkes et al. ..... 482/69
2004/0063550 A1 * 4/2004 Harris ..... 482/69
2004/0143198 A1 * 7/2004 West ..... 601/5
2005/0101448 A1 * 5/2005 He et al. ..... 482/54
2005/0209065 A1 * 9/2005 Schlosser ..... 482/69
2005/0250624 A1 * 11/2005 Yu ..... 482/69
2005/0282632 A1 * 12/2005 James-Herbert ..... 463/36
2006/0128531 A1 * 6/2006 Planke ..... 482/39
2006/0189453 A1 * 8/2006 Leblond ..... 482/69
2006/0240952 A1 * 10/2006 Schlosser ..... 482/69
2007/0004567 A1 * 1/2007 Shetty et al. ..... 482/69
2007/0020594 A1 * 1/2007 Segrest et al. ..... 434/226
2007/0054784 A1 * 3/2007 Wu et al. ..... 482/69
2008/0283692 A1 * 11/2008 Leinen ..... 248/125.8

* cited by examiner

WALKER APPARATUS

BACKGROUND OF THE INVENTION

1. Technical Field

The present invention relates to an improved walker apparatus useful for individuals desiring support while moving. More particularly, the present invention relates to an improved walker apparatus which includes an I.V. stand as well as a pedestal portion with multiple openings for receiving various attachments.

2. Background of the Art

A variety of different support devices have been developed for assisting individuals with walking so as to increase the mobility of the individual. Most often, the support devices are utilized with patients who are either infirm or recovering from surgery and provide an option for mobility for the patient rather than being bedridden. Additionally, the support devices often include attachments which must accompany the user during movement. For example in Sandoval et al., U.S. Pat. No. 4,266,765, a combined patient support and carrier is described which also includes a mobile support for various servicing devices which are required for servicing the patient even while the patient is walking. The apparatus reduces the need for human assistance while enabling the individual to walk and move while still including various servicing devices required by the patient during the movement.

In Eidem (U.S. Pat. No. 4,832,294), a portable stand is described for the transport of fusion pumps, intravenous solutions, and other associated equipment. Generally, the invention comprises a cart for the transport of a variety of equipment including infusion pumps, as well as bottles and gas storage tanks, and furthermore, may also include an upstanding pole for the attachment of an I.V. solution.

In U.S. Pat. No. 5,476,432, Dickens, a medical stroller is described with a support frame as well as a variety of attachments for various medical devices necessary for servicing the patient. Generally, the device completely encompasses the individual and can completely support the weight of a patient, thus preventing the patient from falling to the ground.

Gordon, U.S. Pat. No. 5,704,577, describes a coupler for coupling a conventional I.V. stand to a walker so that the I.V. stand moves with the individual using the conventional style walker for support.

Hamilton (U.S. Pat. No. 6,672,321) describes a walker including a compartment designed to carry an oxygen bottle for users having breathing disorders. The apparatus includes a mount located on the walker to maintain the oxygen bottle in a stable condition so that the user can safely control the walker while moving.

Unfortunately both stand-type devices and walker apparatuses of the prior art are not designed to provide as great a mobility as required by the user. Furthermore, many of the prior art stands and walker apparatuses generally do not include the ability to customize the walker or stand to the individual user's needs. In addition, many prior art walker devices are extremely cumbersome and are not small or compact enough for a user to aptly maneuver.

What is desired, therefore, is an improved walker apparatus which includes an I.V. stand, an oxygen tank holder, as well as the capability of receiving a variety of different attachments. Furthermore, what is desired is a walker apparatus having a compact design which is easily maneuverable by users having low levels of strength. Indeed, a combination of characteristics including the capacity for receiving attachments as well as the improved maneuverability have been found to be necessary for the use of walker apparatuses by infirm, healing or elderly users.

SUMMARY OF THE INVENTION

The present invention provides an improved walker apparatus which is uniquely capable of receiving various attachments required by the user. The inventive walker exhibits an improved customability and maneuverability to provide a combination of characteristics not heretofore seen. The incorporation of an I.V. stand with multiple wheels provides for an improved walker which can be configured and readily used by a patient.

More particularly, the inventive walker apparatus includes a pedestal comprising multiple holes for the attachment of various devices to the improved walker. Generally, with individuals having a variety of different health conditions, various devices are often required by the patient even during movement. For such devices, the pedestal provides a simple method of attaching the required devices so that a patient can maintain access to the device while still retaining their mobility.

The inventive walker should also include handles so that a user may use the walker for support while moving. Generally, these handles are comprised of a tubular design often including a metal, alloy, composite, or polymer with the handles preferably comprising aluminum.

The improved walker should also include an I.V. extension which may attach into the pedestal and extend upward so that an I.V. bag may be maintained in the proper orientation for a user. In a preferred embodiment, the I.V. extension may include at least one hook for the attachment of an I.V. bag thereto.

Furthermore, the improved walker apparatus may also include various attachments comprising a basket, an oxygen tank holder, a chair or the like. The attachments may be attached directly to the walker apparatus through either the attachment holes within the pedestal or other locations on the walker apparatus. For example, the oxygen tank may be attached on the side of the pedestal rather than through the use of one of the attachment holes within the pedestal. Similarly, a basket may be included within the support handles of the walker wherein a user may place small items.

Advantageously, the walker preferably comprises a compact design meaning that the base of the walker does not expand over a large area so that the walker may be easily maneuvered even by patients having little strength. Preferably, the base of the walker is smaller than about 30 inches by about 36 inches although may be either larger or smaller depending on the specific application and needs of the patient.

An object of the invention, therefore, is an improved walker apparatus having characteristics which enable it to be utilized by users requiring support during movement.

Another object of the invention is a walker apparatus having the capacity to accept a variety of attachments so that multiple devices may be transported with the user during movement.

Still another object of the invention is a walker apparatus having an I.V. extension for users requiring the use of an I.V. solution.

Yet another object of the invention is a walker apparatus which may include an attachment for a gaseous bottle for patients needing a specific gas.

Another object of the invention is a walker apparatus which can be produced in a variety of sizes and configurations and customized for the end user.

These aspects and others that will become apparent to the artisan upon review of the following description can be accomplished by providing an improved walker including a pedestal with attachment openings for the receiving of various devices which may accompany the user during walking. The inventive walker apparatus advantageously is highly maneuverable while providing support and supplying the necessary equipment to the user while the user utilizes the walker to assist with walking.

It is to be understood that both the foregoing general description and the following detailed description provide embodiments of the invention and are intended to provide an overview of framework of understanding to nature and character of the invention as it is claimed.

BRIEF DESCRIPTION OF THE OF THE DRAWINGS

DETAILED DESCRIPTION OF THE PREFERRED EMBODIMENTS

Figure 1:
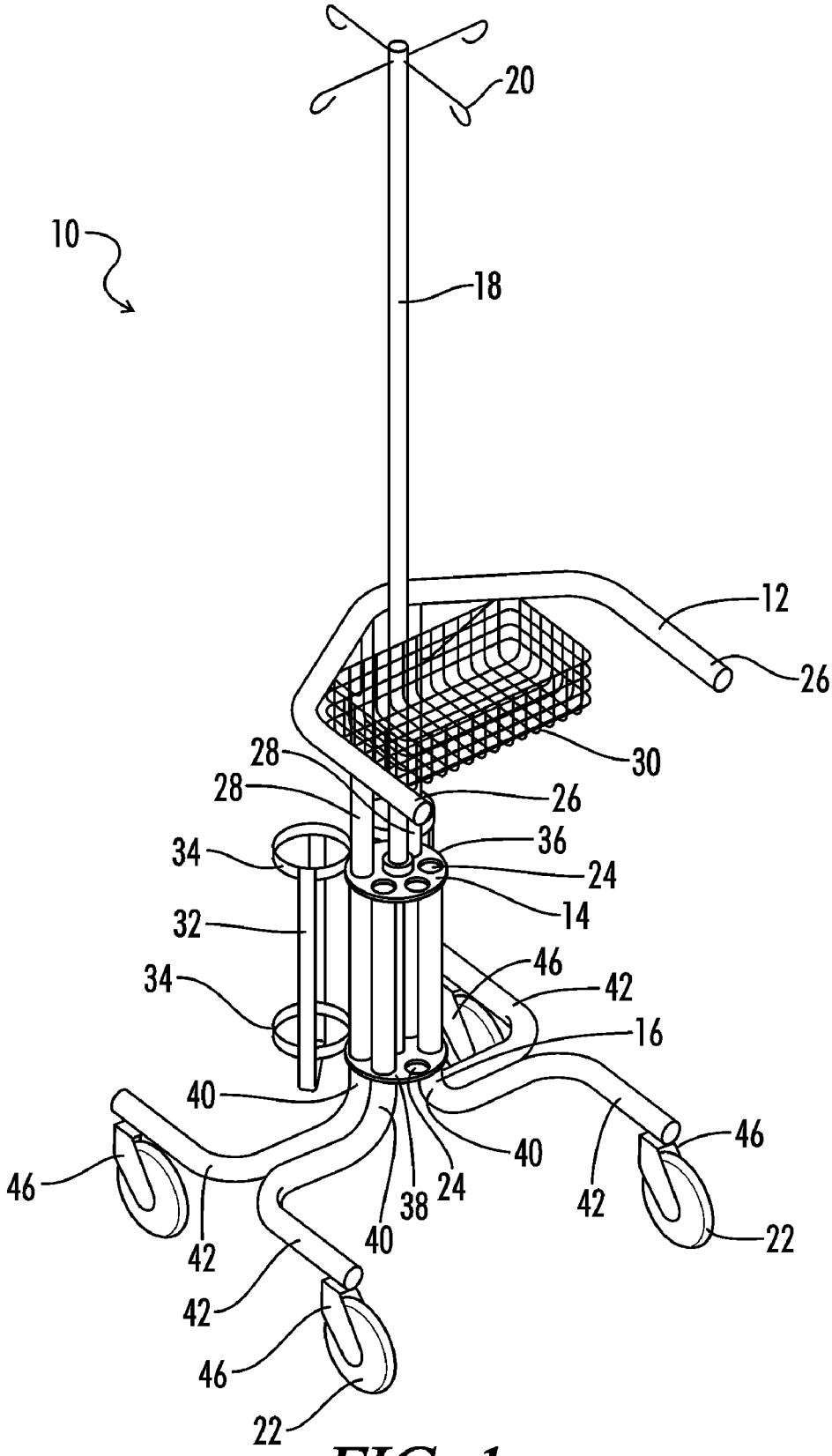
FIG. 1 is a side-top view illustration of the walker apparatus.

Referring generally now to FIG. 1, the improved walker apparatus made in accordance with the current disclosure, is shown and generally embodied as walker 10. Walker 10 can be utilized to provide support to a user (not shown) while also allowing for the transport of various attachments with the user when utilizing walker 10. Generally, walker 10 comprises user supports 12, pedestal 14, and base 16.

As embodied in FIG. 1, walker 10 also includes I.V. extension 18, with I.V. bag hooks 20, for the attachment of I.V. bags (not shown). Generally, I.V. extension 18 extends vertically up from pedestal 14 to a height of from about 50 inches to about 100 inches when measured from the bottom of wheels 22 attached to base 16. In a preferred embodiment, multiple I.V. bag hooks 20 are utilized, however, as few as one bag hook 20 may be utilized at the distal end of I.V. extension 18. Most often, I.V. extension 18 may be comprised of metal or an alloy or a variety of polymers and composites with aluminum being the preferable material for comprising I.V. extension 18. Yet furthermore, I.V. extension 18 is attached to walker 10 via pedestal 14 and in the embodiment as illustrated in FIG. 1 may extend into one of attachment holes 24 located on pedestal 14. In a preferred embodiment, the proximal end of I.V. extension 18 extends into a center attachment hole 24 though may be situated in a variety of attachment holes 24 on pedestal 14 of walker 10. In further embodiments I.V. extension 18 may be permanently attached to walker 10 in a variety of ways including fasteners, bolts, welding, or the like. Additionally, I.V. extension 18 may be of a removable design wherein I.V. extension 18 can be removed when not required by the user.

Walker 10 also includes user support 12 comprising handles 26 for which a user may grasp in obtaining support. As illustrated in the embodiment of walker 10 in FIG. 1, user support 12 may include support extensions 28 which extend about perpendicular to handles 26 and fit within attachment holes 24 of pedestal 14 to provide attachment of user support 12 to walker 10. As such, user support 12 is securely positions on walker 10 and may be able to support the weight of a user utilizing walker 10 for support during walking. In additional embodiments, user support 12 may include either greater or fewer support extensions, thus depending upon the exact design of pedestal 14. Additionally, in yet further embodiments, support extensions 28 may be permanently attached to walker 10 either within pedestal 14 or on the exterior of pedestal 14. Generally, user support 12 is comprised of a metal, alloy, polymer or a composite with the preferable material comprising aluminum which is able to support the force generated by the user when utilizing walker 10 for moving. Optionally, user support 12 may include basket 30 as illustrated in FIG. 1 for the containment and immediate access of items for the user. However, such basket is not required for user support 12 and does not substantially change the support function of user support 12 of walker 10.

Gaseous bottle holder 32 may be attached to a side of pedestal 14 for the containment of a gas bottle for the user. Preferably, gaseous bottle holder 32 comprises a design to hold an oxygen bottle for the use thereof by a patient requiring supplemental oxygen. More specifically, gaseous bottle holder 32 may comprise bottle rings 24 having approximately a three inch to about a six inch outer diameter, and approximately a three inch to about a six inch inner diameter and preferably with bottle rings 24 having about a 4.5 inch outer diameter and a 4.3 inch inner diameter for the containment of an oxygen bottle. Generally, gaseous bottle holder 32 may be attached to pedestal 14 via bolts, screws, nuts, rivets, or a variety of other physical attachments, and furthermore, may also be attached in a removable manner using latches, locks, or other fittings so that gaseous bottle holder 32 may be removed if not necessary for the user.

Pedestal 14 of walker 10 generally includes first surface 36 with attachment holes 24 for receiving the proximal ends of support extension or extensions 28 of user support 12 as well as I.V. extension 18 and any other devices the user chooses to attach to walker 10 through attachment holes 24 on first attachment surface 36 of pedestal 14. Additionally, pedestal 14 also includes second attachment surface 38 also including attachment holes 24 wherein second attachment surface 38 is preferably utilized for attaching base 16 via each base element 42. Both first attachment surface 36 and second attachment surface 38 may include a variety of different numbers of attachment holes 24 although preferably includes anywhere from about two attachment holes 24 to about ten attachment holes 24 for each individual attachment surface. Most preferably, each attachment surface comprises about five attachment holes 24 with the first attachment surface of pedestal 14 including an additional attachment hole 24 for the extension of I.V. extension 18 therethrough. Most notably, by use of the available additional attachment holes 24 in both the first attachment surface 36 and second attachment surface 38, additional devices may be attached to the inventive walker for the user. More specifically, the embodiment as illustrated in FIG. 1 illustrates pedestal 14 having multiple attachment holes 24 for receiving the I.V. extension 18 and support extensions 28, and could additionally include the attachments of a chair, monitoring equipment, additional I.V. extensions, and other servicing devices to walker 10 via the available attachment holes 24. Still furthermore, by the use of pedestal 14 with attachment holes 24, the height of user support 12 is adjustable by inserting support extension or extensions 28 a lesser or greater distance into pedestal 14 through attachment holes 24 on first attachment surface 36. This may comprise pins or other locking devices as well as notches or a friction fit. Preferably, locking pins (not shown) are used to set each support extension 28 at a set depth into pedestal 14. As such, walker 10 may be utilized for a variety of different individuals having differing heights or requiring differing heights for support for gripping handles 26 of user support 12.

Base 16 of walker 10 generally includes individual base elements 42 with distally attached wheels 22 and proximal base attachment extensions 40 for attaching to pedestal 14 of walker 10. In a preferred embodiment, base 16 includes four individual base elements each with an individual wheel 22 although greater or lesser number of base elements may be included, for example, a walker could be created with lesser or greater numbers of base extensions. Most generally, each base element 42 is comprised of a metal, alloy, polymer or composite, and preferably is comprised of aluminum and can include either a curved or straight design. Preferably, as illustrated in FIG. 1, each base element 42 curves in a first plane, thus curing horizontally, and also in a second plane, thus curving vertically, so as to configure base 16 in a manner so as to not interfere with the foot placement of a user while still attaching each individual base element 42 of base 16 to pedestal 14 of walker 10. In further embodiments, each individual base element may curve differently or be straight or be of a variety of angled configurations in comprising base 16. Additionally, in a preferred embodiment, each wheel 22 comprises a caster including off-set steering pivot 46 so that each will automatically swivel so that each wheel may function to be aligned in the direction from which walker 10 is pushed. In further embodiments, either one or more of wheels 22 may not comprise casters, and thus, be fixed in a single orientation. For example, in an embodiment of walker 10 having four wheels, the two wheels farthest from the handles may be casters whereas the other two wheels may not be or vice versa.

Figure 2:
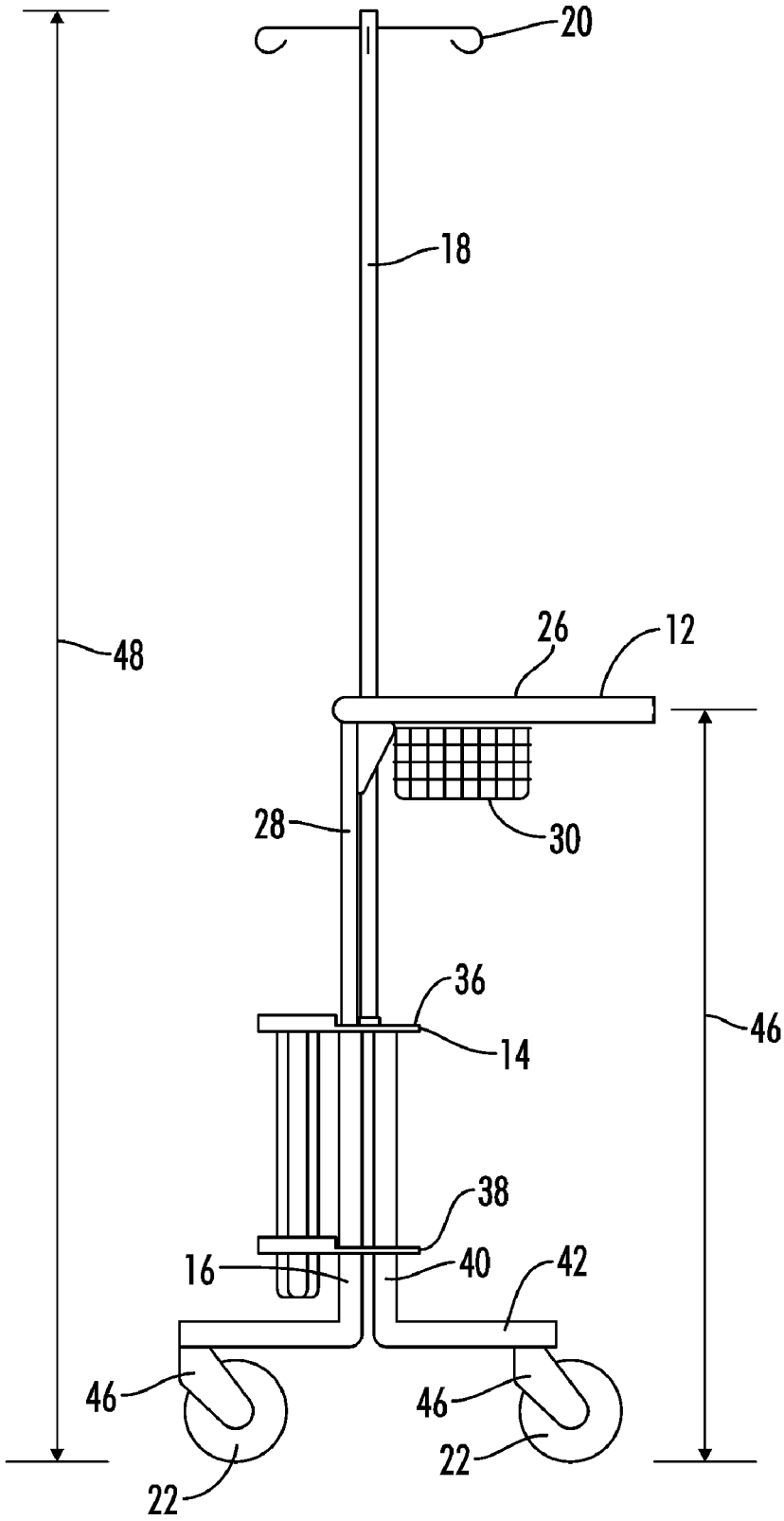
FIG. 2 is a side view illustration of the walker apparatus.

FIG. 2 illustrates a side view perspective of walker 10. Generally, the distance from handles 26 of user support 12 to the bottom of wheels 22 is from about 30 inches to about 60 inches, and more preferably of from about 40 inches to about 45 inches. Additionally, overall height 48 of walker 10 is of from about 60 inches to about 100 inches, and more preferably of from about 80 inches to about 90 inches. Furthermore, handles 26 of user support 12 are preferably illustrated in FIG. 2 as being substantially horizontal and essentially parallel with a level floor although further embodiments may include handles 26 which curve or angle upwards or downwards so as to not be parallel to a level ground surface.

Figure 3:
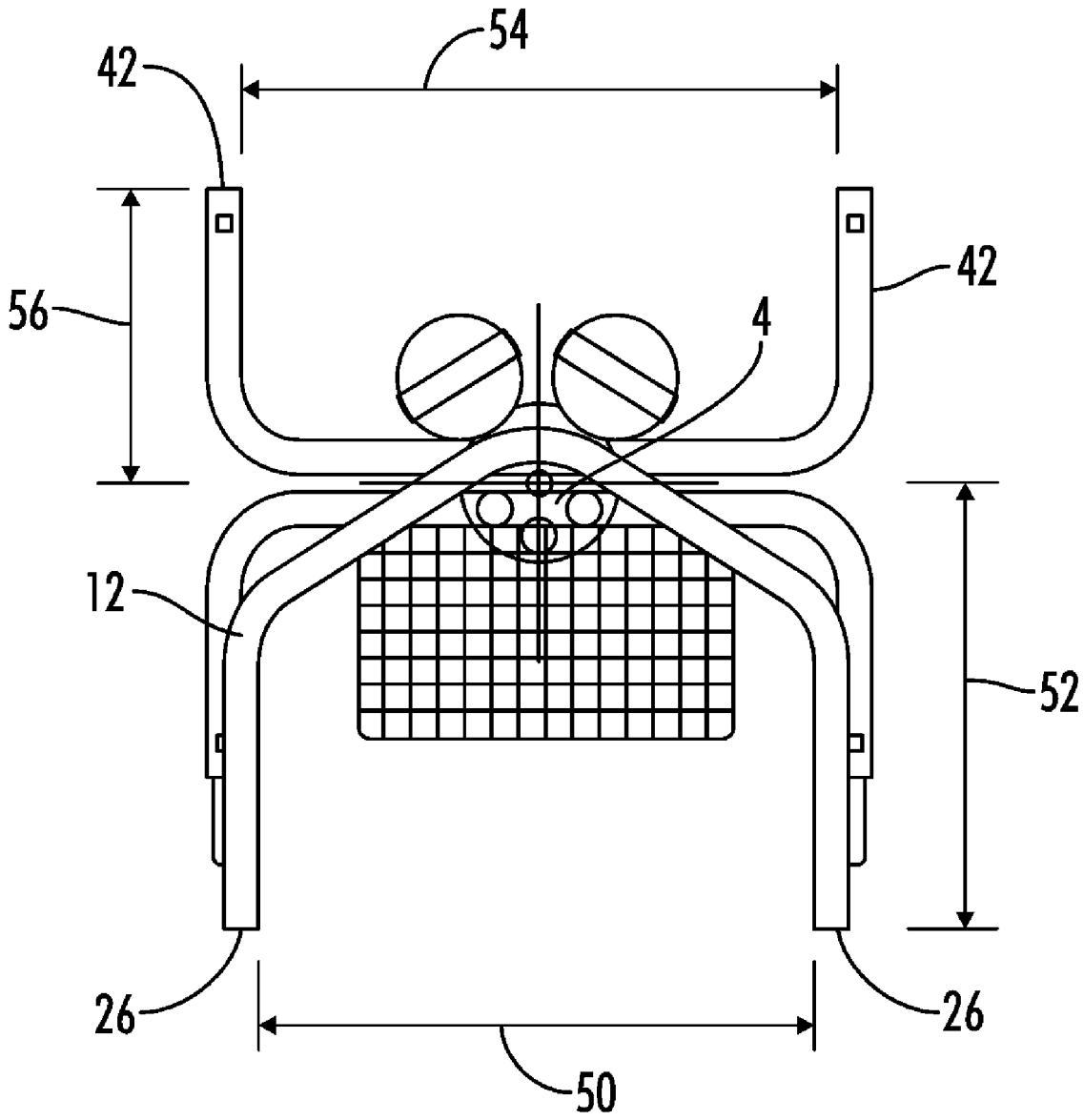
FIG. 3 is an overhead view illustration of the walker apparatus.

FIG. 3 illustrates a top view of walker 10 thus illustrating the compact design of walker 10. Preferably the distance between each handle 26 of user support 12 comprises of from about 16 inches to about 28 inches and more preferably of from about 20 inches to 24 inches illustrated as inner handle length 50. Additionally, the length from the end of each handle 26 to approximately the middle of pedestal 4 is of from about 12 inches to about 20 inches and more preferably of from about 15 inches to about 19 inches and is illustrated generally as numeral 52. Furthermore, the inner base element distance as measured between adjacent base elements 42 is of from about 18 inches to about 28 inches and more preferably of from about 20 inches to about 26 inches and is designated by numeral 54 on FIG. 3. Yet furthermore, the length from the distal end of a base element 42 to approximately the mid point of pedestal 14 when measured in a horizontal plane is of from about 14 inches to about 20 inches and more preferably of from about 16 inches to about 18 inches and generally designated by numeral 56. Generally, any of these measurements including 50, 52, 54, and 56 may be greater or lesser than the ranges described depending on the needs of the user and thus should not be limited as such.

Walker 10 comprises a compact design and occupies little area on the floor on which it rolls thus providing a user with great control over the maneuverability of walker 10. As such, a user may utilize walker 10 by placing either one or both hands on handles 26 of user support 12 and pushing walker 10 in the direction the user desires to move. During movement and even when walker 10 is at rest, a user may hold on to handles 26 for support and balance thus assisting either infirm or healing patients as well as weak individuals. Furthermore, through the use of the attachment holes on the pedestal of the walker, a user may include a variety of medical equipment and other devices with them while they move with the walker. Thus, the individual is provided the opportunity to move whereas the individual might have been previously bedridden due to weakness or the multitude of equipment required for medical servicing. Furthermore, the upright design of the walker with its relatively small base area enables the walker to be highly maneuverable while still providing support to the user.

Accordingly by the practice of the present invention, a walker having heretofore unrecognized characteristics is disclosed. These embodiments of a walker exhibit improved maneuverability and the capacity of a variety of different attachments to the walker all while allowing a user to utilize the walker for support while moving.

The disclosure of all cited patents and publications referred to in this application are incorporated herein by reference.

The above description is intended to enable the person skilled in the art to practice the invention. It is not intended to detail all the possible variations and modification that are apparent to the skilled worker upon reading the description. It is intended, however, that all such modifications and variations be included within the scope of the invention that is defined by the following claims. The claims are intended to cover the indicated elements and steps that any arrangement or sequence that is effective to meet the objectives intended for the invention unless the context specifically indicate the contrary.

Thus, although there have been described particular embodiments of the present invention of a new and useful Improved Walker Apparatus, it is not intended that such references be construed as limitations upon the scope of this invention except as set forth in the following claims.

What is claimed is:

1. A walker apparatus comprising:

a base with base extensions with each extension having a distal end and a proximal end and a wheel attached to the distal end of each base extension;

a pedestal connected to the base with the pedestal having a plurality of attachment holes for receiving amenities;

each of the base extensions extending outward from below the pedestal in a first direction with two of the base extensions then extending in a second direction to each of the two base extensions' distal ends;

the two base extensions extending in the second direction separated by at least eighteen inches from one another at the distal ends;

a user support attached to the pedestal with two handles to provide support to a user;

each of the two handle extending outward from above the about center of the base in a first direction with each of the two handles then continuing to extend in a second direction and terminating in separate ends, the portions of the handles extending in the second direction to each separate end being separated by at least sixteen inches at the separate ends;

the two handles oriented above the two base extensions extending in a second direction and forming a continuous open area from between the two base extensions spanning to between the two handles for a user to walk; and a removable I.V. extension attached to the pedestal for maintaining an I.V. bag wherein the I.V. extension and amenities are removable from the pedestal for providing a variety of configurations of the walker apparatus.

2. The walker of claim 1 further comprising a gaseous bottle attached to the pedestal.

3. The walker of claim 2 wherein the gaseous bottle is an oxygen bottle.

4. The walker of claim 1 further comprising at least one I.V. bag hook located on the I.V. extension.

5. The walker of claim 1 wherein the wheel comprises a caster.

6. The walker of claim 1 wherein the walker comprises a material selected from the group consisting of metals, alloys, composites, polymers, and combinations thereof.

7. The walker of claim 1 wherein the walker is comprised of aluminum.

8. The walker of claim 1 wherein the pedestal is an adjustable height pedestal.

9. The walker of claim 1 wherein the pedestal further comprises a plurality of attachment holes.

10. The walker of claim 9 wherein the pedestal further comprises a first attachment surface with attachment holes and a second attachment surface with attachment holes.

11. The walker of claim 9 wherein the attachment holes may accommodate a variety of devices.

12. The walker of claim 11 where the devices are selected from the group consisting of I.V. extensions, servicing devices, chairs, gaseous bottles, baskets, monitoring equipment and combinations thereof.

13. A walker apparatus comprising:

a base with base extensions with each extension having a distal end and a proximal end and a wheel attached to the distal end of each base extension;

a pedestal connected to the base with the pedestal having a plurality of attachment holes for receiving amenities;

each of the base extensions extending outward from the proximal end at below the pedestal in a first direction and then extending a second direction in forming a generally L-shaped orientation;

two of the base extensions having their L-shaped orientations arranged to form an interior space between the two base extensions;

a user support attached to the pedestal with two handles to provide support to a user;

each of the two handle extending outward from above the about center of the base in a first direction with each of the two handles then continuing to extend in a second direction and terminating in separate ends with the two handles forming together a generally U-shaped orientation of the two handles;

each separate end of the handles forming together the generally U-shaped orientation of the two handles being about parallel to one another and separated by an interior space;

the interior space formed by the generally U-shaped orientation of the two handles oriented above the interior space formed between two base extensions to form an area for a user; and a removable I.V. extension attached to the pedestal for maintaining an I.V. bag wherein the I.V. extension and amenities are removable from the pedestal for providing a variety of configurations of the walker apparatus.

* * * * *